United States Patent [19]

Anderson

[11] Patent Number: 5,017,242

[45] Date of Patent: May 21, 1991

[54] CAN-CONVEYOR SYSTEM AND RINSER

[76] Inventor: Jon V. Anderson, P.O. Box 116, Ocoee, Fla. 34761

[21] Appl. No.: 416,349

[22] Filed: Oct. 3, 1989

[51] Int. Cl.[5] ..... B08B 7/04

[52] U.S. Cl. ..... 134/22.18; 134/22.16; 134/24; 134/32; 134/62; 134/64 R; 134/83; 134/130; 134/167 R; 134/169 R

[58] Field of Search ..... 134/24, 32, 22.18, 22.16, 134/130, 62, 64 R, 83, 167 R, 169 R, 184; 15/392

[56] References Cited

U.S. PATENT DOCUMENTS

| | | | |
|---|---|---|---|
| 3,056,414 | 7/1963 | Nolte | 134/30 |
| 3,587,597 | 6/1971 | Courtney et al. | 134/170 |
| 4,051,805 | 10/1977 | Waldrum | 134/170 |
| 4,125,120 | 11/1978 | Standley | 134/29 |
| 4,830,676 | 5/1989 | Eggers | 134/24 |

*Primary Examiner*—Asok Pal

*Attorney, Agent, or Firm*—James H. Beusse

[57] ABSTRACT

A rinser for a gravity feed can conveyor system includes a plurality of nozzles for directing high pressure water into the cans as they pass by the rinser. At least some of the nozzles are angular oriented with respect to the cans in the conveyor system so that some water impinges on side surfaces of the cans in such a manner as to urge the cans through the conveyor. A rotator following the rinser rotates the cans from a downward angle to a vertical position for filling in at least three succeeding sections of conveyor.

11 Claims, 1 Drawing Sheet

CAN-CONVEYOR SYSTEM AND RINSER

FIELD OF THE INVENTION

The present invention relates to can conveyor systems, and more particularly, to a can conveyor system and rinser for high speed processing of empty cans.

BACKGROUND OF THE INVENTION

Gravity feed can conveyors are used to transport cans from a storage or preprocessing area to a filling machine. At this stage, the cans are essentially open ended containers. Tops are attached to the cans only after filling. During transport, the cans are generally passed through a rinser which cleans various contaminants, such as dust, from the cans prior to reaching the filling machine. The conveyors normally transport the cans in a horizontal orientation, i.e., in an orientation in which the cans can roll. As the cans approach the rinser, they are rotated into a tilted position with the open ends angled downwardly, typically at about 35° below horizontal. Upon exiting the rinser, the cans are passed through a rotator, essentially a short section of conveyor, which rotates the cans into an upright position.

The rinser section of a gravity feed can conveyor has always presented a slow-down in can movement. Rinsers commonly comprise a water feed line running parallel to the conveyor with a plurality of nozzles directing water in a transverse direction with respect to the direction of movement of cans on the conveyor, so that water enters the open end of the cans to effectively rinse contaminants out. The water is directed at the cans as a spray under relatively high pressure. This water spray forces the cans away from the nozzles such that the closed ends of the cans abut against a guide rail of the conveyor. This abutting action creates a friction interface which tends to slow movement of the cans.

In early systems, cans were processed at relatively slow rates, such as, for example, at 400 to 500 cans per minute. Additionally, cans were formed from steel and had a much greater weight than present day thin wall aluminum cans. At slower speeds and with greater weight, the cans could be processed through the aforementioned rinsers adequately although the rinser was often the limiting factor in conveyor line speed. In present day systems, an empty aluminum soft drink or beer can weighs less than half an ounce so that the effect of a high intensity rinser spray is greater and the gravitational force on the cans is less. Furthermore, new systems are intended to operate at speeds exceeding 1500 cans per minute so that restrictions at such rinsers are more critical.

Still further, the prior art systems are arranged to rotate the cans exiting the rinser in a single stage rotator. This rotator comprises a relatively short section of conveyor trackwork which transitions the cans from the below horizontal orientation to an upright or vertical orientation necessary to fill each can. These short rotation sections have also been found to contribute to can slow-down and, in addition, often result in damage to the cans as they are pushed into side rails of the conveyor trackwork. Such pushing and damage can cause misalignment of the cans as they enter the filling machine and result in incomplete filling of some cans.

SUMMARY OF THE INVENTION

It is a general object of the present invention to provide a gravity feed system and rinser which overcomes the above and other disadvantages of the prior art.

It is another object of the invention to provide a rinser which enhances flow of cans along a conveyor trackwork.

It is yet another object of the present invention to provide a conveyor system and rinser which reduces damage and misalignment of cans entering a filling machine.

It is still another object of the present invention to provide a can conveyor system and rinser for high speed can conveyor operation.

The above and other objects, features, and advantages are attained in the present invention in one form in which a rinser is constructed with a plurality of water injection nozzles for directing water onto cans in a gravity feed conveyor trackwork. At least some of the nozzles are arranged to direct water angularly onto the cans proceeding through the trackwork in a direction to assist in urging the cans through the rinser. The trackwork is sloped, so that gravity pulls the cans through the rinser, and tilted so that water entering the cans will run out. The system includes a section of trackwork following the rinser and oriented at the same angle for allowing further draining of the rinsed cans. A subsequent trackwork section rotates the cans back to a horizontal orientation. A following section thereafter rotates the cans to a vertical orientation for filling.

The invention comprises a method of maintaining a preselected speed of at least one can passing through a gravity feed can receiver. The can includes a sidewall, a closed end wall defining a chamber within the can, and an open end communicating with the chamber. The gravity feed rinser includes chute means for the gravity passage therethrough of the can and a plurality of nozzles.

The invention further comprises a method of maintaining a preselected speed including a first step of applying water from successive nozzles into the chambers of the cans during their gravity passage through the chute. This step effects a reduction from the preselected speed of the cans in response to the applying step. Secondly, the method includes the step of directing water from other nozzles onto the sidewalls of the cans exteriorly during their gravity passage through the chute means and counteracting the tendency of the cans to slow down so as to maintain the preselected speed of the cans during their passage through the chute means.

The high speed gravity feed can conveyor system includes an integral can rinser for rinsing cans prior to filling the cans having one open end. The system further includes a first section of can conveyor extending through the can rinser which has a preselected slope of about 30° for urging cans on the conveyor in a predetermined direction through the first section. The first section is tilted so that the open ends of the cans are angled below horizontal. The can rinser is positioned adjacent the first section and comprises an elongated water feed pipe which extends substantially parallel to the first section and a plurality of nozzles which extends from the water feed pipe toward cans traversing the first section. Selected ones of the nozzles are angularly oriented for expelling a water stream in a direction for pushing the cans in a predetermined direction.

A second section of can conveyor continues from the first section for a predetermined distance with the cans angled below horizontal for draining water therefrom, while a third section of can conveyor continues from the second section and gradually transitions to a non-tilted orientation for aligning the cans in a horizontal position. Finally, a fourth section of can conveyor continues from the third section and gradually transitions to a vertical orientation for aligning the cans with the open ends vertical to permit filling of the cans.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
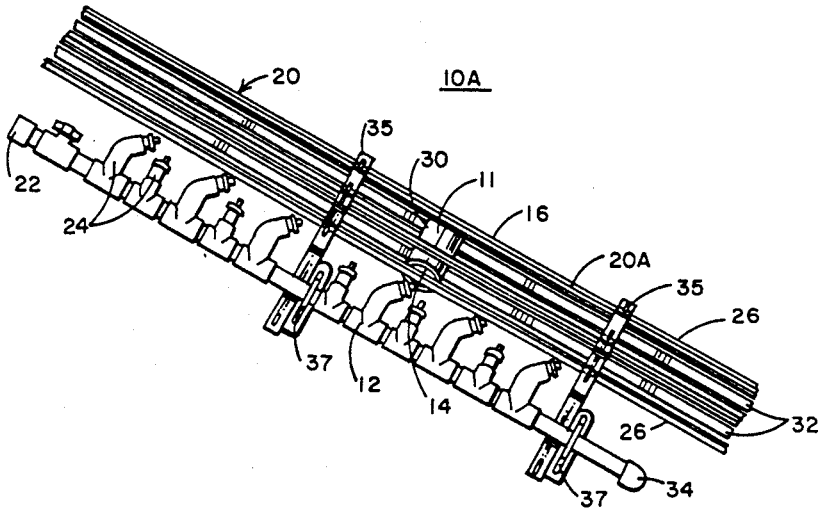
FIG. 1 is a perspective view of a first section of conveyor trackwork including a can rinser in accordance with the present invention.
Figure 2:
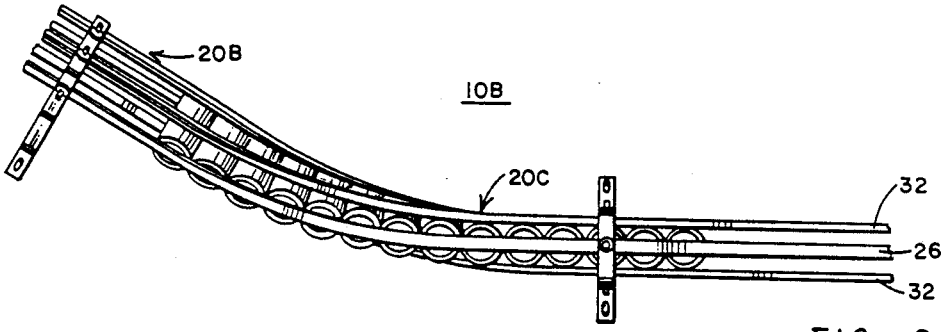
FIGS. 2–3 illustrates conveyor system trackwork in accordance with the present invention for transitioning cans from the rinser section of FIG. 1 to a vertical orientation.
Figure 3:
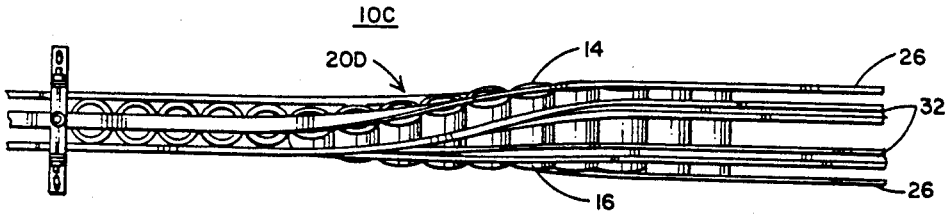

Referring now to FIGS. 1–3, there is shown a first section 10A of a high speed gravity feed can chute or conveyor system 10 with an integral can rinser 12 for rinsing cans prior to filling. The cans 11 entering the first section 10A of the can conveyor system 10 are formed with one open end 14 and one closed end 16. After filling the cans, a top (not shown) is then attached to the cans. The conveyor trackwork 20 leading into the first conveyor section 10A with the rinser 12 is arranged to orient the cans so that the open end 14 is pointing downward at about an angle of 35° with respect to a horizontal plane. The trackwork 20 itself may be also angled downwardly at about 30° in order to facilitate movement of the cans by gravity through the trackwork 20. As the cans enter the first section of trackwork 20A, the can rinser 12 comprising a water feed line 22 and a plurality of water injection nozzles 24, positioned adjacent and parallel to the first track section 20A is energized to cause water at relatively high pressure to exit the nozzles 24. The force of the water from the nozzles 24 pushes the cans 11 back against the side rails 26 of the trackwork 20 opposite the rinser nozzles 24. The friction between the bottoms 16 of the cans on the trackwork 20 tends to slow the movement of the cans through the trackwork creating a slow-sown of the processing of the cans. In applicants' inventive system, alternate ones of the nozzles 24 in the rinser 12 are angled at approximately 45° with respect to the direction of movement of the cans 11 through the rinser 12. Water exiting from these angled ones of the nozzles 24 impinges on the sides 30 of the cans, i.e., on both the outside and inside surfaces of the cans, and is forced at a direction to urge movement of the cans past the rinser 12. The water directed from the angled nozzles 24 onto the side walls 30 of the cans is sufficient to counteract the tendency of the cans to bind on the rails 26 of the can conveyor trackwork 20 and thus to maintain the preselected speed of the cans through the rinser system.

The can conveyor trackwork 20 comprises a plurality of half-round steel guide rails forming an enclosure for containing cans passing through the trackwork. In general, there is provided two half-round rails 32 on the top and bottom of the trackwork, the top and bottom being defined by the normal orientation of the trackwork 20 with the cans in a horizontal position. The side rails 26 of the trackwork 20 which contain the cans are usually single rails also formed of a half-round material which may be further coated with a plastic surface to provide for easier movement of the cans along the rail. As shown in FIG. 1, the nozzles 24 from the rinser 12 are positioned to direct water into the cans from just below a side rail 26 so that the cans are forced away from the rinser 12 with their bottoms 16 impinging on the opposite side rail 26.

Figure 4:
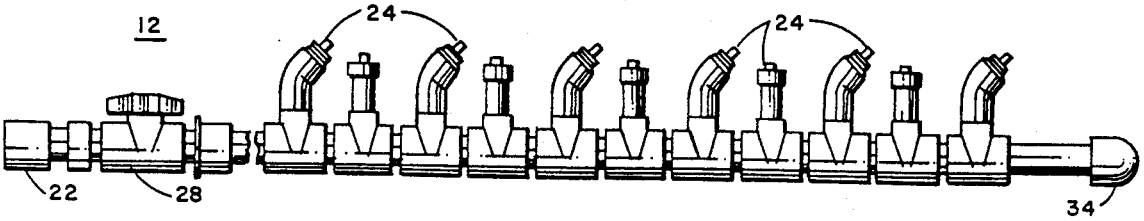
FIG. 4 is a more detailed drawing of the rinser of FIG. 1.

Referring to FIG. 4, in a preferred embodiment, the extent of the rinser 12 may comprise approximately five feet. The nozzles 24 may be spaced between about four and six inches apart and it is preferable that the first and last nozzle in the rinser 12 comprise angled ones of the nozzles 24 to assist in moving the cans through the rinser 12. A valve 28 may be provided at one end of the rinser feed line 22 and a cap 34 at an opposite end. The rinser 12 is preferably clamped to the support brackets 35 by clamps 37 as shown in FIG. 1. The brackets 35 also support the positioning of the rails 26 and 32 of the trackwork 20.

Applicants have also found that cans leaving the rinser section are sometimes damaged and/or misaligned so that filling of the cans may be incomplete when the cans reach a filling machine. Applicants believe that the cause of this damage and misalignment is the conventional method of rotating the cans from the below horizontal position to a vertical position in order to feed the cans into the filling machine. In general, the prior art utilizes a single stage rotator connected at the exit of the rinser section for rotating the cans from their essentially horizontal position to a vertical position. The rotator merely comprises a section of trackwork which gradually curves in a downward direction similar to a corkscrew in order to rotate the cans. In rotating such cans in the conventional rotator, the cans tend to bind against the side rails of the trackwork and to be compressed or pushed by following cans. For very high speed operation, it is desirable to minimize transit time through the rinser and to process the cans from their below horizontal orientation to a vertical orientation without damage to the cans.

In applicants' invention as shown in FIGS. 2–3, the cans are processed through three additional sections of trackwork 20B, 20C, and 20D in order to bring them to a filling machine (not shown) at maximum speed and without damage or misalignment. In a second section 20B of trackwork immediately following the can rinser first section 12A, the cans are maintained in their below horizontal orientation for approximately five feet in order to allow further drainage of water from the cans. Following the second section 20B, the trackwork continues into a third section 20C which gradually rotates the cans from their below horizontal angle to a horizontal orientation. This transitions the cans through approximately 35°. In a final fourth section 20D of the trackwork, the cans are then processed through a 90° rotator section which gradually moves the cans from a horizontal position to a vertical position, i.e., through 90°. Applicants have found that by transitioning the cans in two separate stages, the disadvantages associated with the prior art rotators can be avoided. While the trackwork is shown as approaching horizontal in FIGS. 2-3, it will be recognized that the trackwork may continue at a downward angle similar to that of FIG. 1 until reaching a filling machine.

It will be appreciated that what has been described is both an apparatus and a method for maintaining a preselected speed of cans passing through a gravity feed can conveyor section 10 including a rinser 12 in which water is successively applied from a plurality of nozzles 24 into the interior of the cans during their gravity passage through the rinser 12. While the application of water tends to effect a reduction in the velocity of the cans from the preselected speed, the invention includes a plurality of successive ones of the nozzles 24 intermediate the other nozzles 24 for directing water onto the cans such that the water impinges against the side walls 30 of the cans in a direction to urge the cans through the trackwork 20. The angularly directed water hitting the sides 30 of the cans counteracts the tendency of the cans to bind on the trackwork 20 and thereby maintains the preselected speed of the cans during their passage through the rinser 12. The invention further includes directing the cans into a second section 20B of trackwork which allows the cans to complete draining before directing the cans into a rotator. The rotator comprises a third section 20C of trackwork which gradually transitions the cans from their below horizontal orientation to a horizontal position and a fourth section 20D of trackwork which thereafter rotates the cans from the horizontal to a vertical position for entering into a filling machine.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the scope of the invention as set forth in the claims which follow.

What is claimed is:

1. A method of maintaining a preselected speed of at least one can passing through a gravity feed can rinser, the at least one can including a sidewall and a closed end wall defining a chamber within the at least one can, and an open end communicating with the chamber, the gravity feed rinser including chute means for the gravity passage therethrough of the at least one can, and a plurality of water nozzles, the method comprising the steps of:

applying water from successive respective ones of the nozzles into the chamber of the at least one can during the can's gravity passage through the chute means and tending to effect a reduction from the preselected speed of the at least one can in response to the applying step; and directing water from successive respective other ones of the nozzles intermediate the successive respective ones of the nozzles onto the sidewall of the at least one can exteriorly thereof during the gravity passage of the at least one can through the chute means and counteracting thereby the tending step so as to maintain the preselected speed of the at least one can during the can's passage through the chute means.

2. The method as set forth in claim 1 wherein the applying step includes reacting the water against at least the closed end within the chamber and establishing a force acting on the at least one can in response to the reacting step.

3. The method as set forth in claim 2 wherein the tending step includes frictionally engaging at least the closed end with a confronting part of the chute means in response to the established force.

4. The method as set forth in claim 1 wherein the directing step includes angularly exerting the water against the sidewall and establishing a force at least in part urging the at least one can in the direction of the can's passage through the chute means.

5. The method as set forth in claim 4 wherein the counteracting step includes utilizing the established force to overcome the speed reduction effected during the tending step.

6. A high speed gravity feed can conveyor system with integral can rinser for rinsing cans prior to filling the cans having one open end, said system comprising:

at least a first section of can conveyor extending through a can rinser, said first section having a preselected slope for urging cans on the conveyor in a predetermined direction through the first section, said first section being tilted such that open ends of the cans are angled below horizontal; and a can rinser positioned adjacent said first section, said can rinser comprising an elongated water feed pipe extending substantially parallel to said first section and a plurality of nozzles extending from the water feed pipe toward cans traversing said first section, alternate ones of said nozzles being angularly oriented for expelling a water stream in a direction for pushing the cans in the predetermined direction.

7. The can conveyor system of claim 6 and further including:

a second section of can conveyor continuing from said first section for a predetermined distance with the cans angled below horizontal for draining water therefrom;

a third section of can conveyor continuing from said second section and gradually transitioning to a non-tilted orientation for aligning the cans in a horizontal position; and a fourth section of can conveyor continuing from said third section and gradually transitioning to a vertical orientation for aligning the cans with the open ends vertical to permit filling of the cans.

8. The can conveyor system of claim 6 wherein said preselected slope is about 30°.

9. The can conveyor system of claim 6 wherein said first section is tilted at an angle of about 35°.

10. The can conveyor system of claim 6 wherein said angularly oriented nozzles are directed at an angle of about 45° with respect to the direction of motion of the cans.

11. The can conveyor system of claim 6 wherein a first one and at least one of the plurality of nozzles are angularly oriented ones of said nozzles.

* * * * *